US006769363B2

(12) United States Patent
Vrotacoe et al.

(10) Patent No.: US 6,769,363 B2
(45) Date of Patent: Aug. 3, 2004

(54) DEVICE AND METHOD FOR MANUFACTURING A TUBULAR PRINTING BLANKET

(75) Inventors: James Brian Vrotacoe, Rochester, NH (US); Roland Thomas Palmatier, Durham, NH (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/893,757

(22) Filed: Jun. 27, 2001

(65) Prior Publication Data

US 2003/0000403 A1 Jan. 2, 2003

(51) Int. Cl.[7] ..... B41N 10/00

(52) U.S. Cl. ..... 101/401.1; 101/375; 29/895.32; 492/49

(58) Field of Search ..... 101/217, 375, 101/376, 401.1; 29/895.3, 895.32; 492/16, 18, 49, 56

(56) References Cited

U.S. PATENT DOCUMENTS

| | | | | |
|---|---|---|---|---|
| 4,093,487 A | * | 6/1978 | Gaworowski et al. | 428/909 |
| 4,767,793 A | * | 8/1988 | Schisler et al. | 521/50.5 |
| 5,301,610 A | * | 4/1994 | McConnell | 101/401.1 |
| 5,304,267 A | | 4/1994 | Vrotacoe et al. | 156/86 |
| 5,323,702 A | | 6/1994 | Vrotacoe et al. | 101/217 |
| 5,429,048 A | | 7/1995 | Gaffney et al. | 101/217 |
| 5,440,981 A | | 8/1995 | Vrotacoe et al. | 101/217 |
| 5,553,541 A | | 9/1996 | Vrotacoe et al. | 101/217 |
| 5,700,343 A | * | 12/1997 | Castelli et al. | 428/909 |
| 5,768,990 A | | 6/1998 | Vrotacoe et al. | 101/217 |
| 5,797,322 A | * | 8/1998 | Lorig et al. | 101/375 |
| 5,798,019 A | * | 8/1998 | Cushner et al. | 156/425 |
| 5,840,386 A | * | 11/1998 | Hatch et al. | 101/375 |
| 5,974,973 A | * | 11/1999 | Tittgemeyer | 101/375 |
| 6,227,109 B1 | * | 5/2001 | Inoue et al. | 101/177 |
| 6,257,140 B1 | * | 7/2001 | Palmatier et al. | 101/401.1 |
| 6,425,327 B1 | * | 7/2002 | Fan et al. | 101/401.1 |

FOREIGN PATENT DOCUMENTS

| | | |
|---|---|---|
| DE | 19720549 | 5/1997 |

* cited by examiner

*Primary Examiner*—Stephen R. Funk
(74) *Attorney, Agent, or Firm*—Davidson, Davidson & Kappel, LLC

(57) ABSTRACT

A device for manufacturing a printing blanket includes a base sleeve, a liquid applicator applying a radiation-curing polymer to the base sleeve, and a radiation source curing the radiation-curing polymer. A method for forming a tubular printing blanket includes placing a radiation-curable polymer over a base so as to form a layer of a printing blanket, and curing the radiation-curable polymer using a radiation source.

14 Claims, 2 Drawing Sheets

DEVICE AND METHOD FOR MANUFACTURING A TUBULAR PRINTING BLANKET

BACKGROUND INFORMATION

The present invention relates to the offset printing blankets, and more particularly, to tubular offset lithographic printing blankets and methods for manufacturing the same.

A web offset printing press typically includes a plate cylinder, a blanket cylinder and an impression cylinder supported for rotation in the press. The plate cylinder carries a printing plate having a rigid surface defining an image to be printed. The blanket cylinder carries a printing blanket having a flexible surface which contacts the printing plate at a nip between the plate cylinder and the blanket cylinder. A web to be printed moves through a nip between the blanket cylinder and the impression cylinder. Ink is applied to the surface of the printing plate on the plate cylinder. An inked image is picked up by the printing blanket at the nip between the blanket cylinder and the plate cylinder, and is transferred from the printing blanket to the web at the nip between the blanket cylinder and the impression cylinder. The impression cylinder can be another blanket cylinder for printing on the opposite side of the web.

A conventional printing blanket is manufactured as a flat sheet. Such a printing blanket is mounted on a blanket cylinder by wrapping the sheet around the blanket cylinder and by attaching the opposite ends of the sheet to the blanket cylinder in an axially extending gap in the blanket cylinder. The adjoining opposite ends of the sheet define a gap extending axially along the length of the printing blanket. The gap moves through the nip between the blanket cylinder and the plate cylinder, and also moves through the nip between the blanket cylinder and the impression cylinder, each time the blanket cylinder rotates.

When the leading and trailing edges of the gap at the printing blanket move through the nip between the blanket cylinder and an adjacent cylinder, pressure between the blanket cylinder and the adjacent cylinder is relieved and established, respectively. The repeated relieving and establishing of pressure at the gap causes vibrations and shock loads in the cylinders and throughout the printing press. Such vibrations and shock loads detrimentally affect print quality. For example, at the time that the gap relieves and establishes pressure at the nip between the blanket cylinder and the plate cylinder, printing may be taking place on the web moving through the nip between the blanket cylinder and the impression cylinder. Any movement of the blanket cylinder or the printing blanket caused by the relieving and establishing of pressure at that time can smear the image which is transferred from the printing blanket to the web. Likewise, when the gap in the printing blanket moves through the nip between the blanket cylinder and the impression cylinder, an image being picked up from the printing plate by the printing blanket at the other nip can be smeared. The result of the vibrations and shock loads caused by the gap in the printing blanket has been an undesirably low limit to the speed at which printing presses can be run with acceptable print quality.

In response to these deficiencies in conventional flat printing blankets, gapless tubular printing blankets were developed by the assignee of the present invention. These gapless tubular printing blankets are described, for example, in U.S. Pat. Nos. 5,768,990, 5,553,541, 5,440,981, 5,429,048, 5,323,702, and 5,304,267.

SUMMARY OF THE INVENTION

The methods for manufacturing gapless tubular printing blankets described above suffer from the deficiency that they produce blankets in batch mode (i.e. one at a time) with a fixed axial length. Batch mode production increases production costs, increases production time, and results in batch to batch variability in the blankets produced.

Commonly-assigned U.S. Pat. No. 6,257,140, which is hereby incorporated by reference herein, describes gapless tubular printing blankets produced continuously and cut to length as desired. The sleeve and print layer are "continuously" formed in that the sleeve forming station continues to form an additional portion of the sleeve while the print layer forming station applies the print layer to the previously formed portion of the sleeve. Wound tapes or cross-head extruders are used to apply various layers.

Commonly-assigned U.S. patent application Ser. No. 09/716,696, which is hereby incorporated by reference herein, provides for ribbon casting of materials to form various layers of a tubular printing blanket. "Ribbon casting" occurs when a liquid material is deposited from a stationary source onto a rotating and translating substrate or that a liquid is deposited from a rotating source onto a translating substrate. A continuous ribbon of liquid material thus can be placed on the substrate. Urethane is used in the ribbon casting process. The urethane sets after a certain time.

Ribbon-casting can be expensive and complicated, and the process slow.

The present invention provides a device for manufacturing a continuous printing blanket comprising:

abase sleeve;

a liquid applicator applying a radiation-curing polymer to the base sleeve; and a radiation source curing the radiation-curing polymer.

By using radiation, the polymer can be cured almost instantaneously. The present device thus provides for more cost-effective and quicker manufacture of printing blankets. Ribbon casting, while possible with the present device, is not necessary. Standard thin film application devices such as blades, rolls, nozzles, sprayers, anilox roller can be used as the applicator to apply a thin layer of the radiation-curing polymer.

Preferably, a second liquid applicator then applies a second polymer over the cured polymer. The radiation curing polymer thus preferably is a compressible liquid polymer, such as urethane mixed with microspheres, carbon dioxide, a blowing agent or water, for example.

Preferably, the radiation-curing polymer is polyurethane, and the radiation source is ultraviolet light. An electron beam also may be used for curing the polymer.

The present device preferably includes a rotation device for rotating the base sleeve, and the base sleeve and rotation device may be similar to the base device used to form blankets in U.S. patent application Ser. No. 09/716,696.

Optional surface finishers for smoothing the surface may be located along the base sleeve between the applicator and the radiation source and after the radiation source.

The sleeve may be formed continuously, so that a cutting device may be provided to cut the sleeve when a desired sleeve length is reached.

The base sleeve may or may not be part of the finished blanket.

The present invention also provides a method for forming a tubular printing blanket comprising the steps of:

placing a radiation-curable polymer over a base sleeve; and curing the radiation-curable polymer using a radiation source.

Preferably, the method further includes rotating the base sleeve.

The radiation curable polymer preferably is a compressible material, and the method further includes providing a print layer over the compressible material.

The curing step preferably takes place in a few seconds, although times up to 5 minutes are possible.

A smoothing step may be provided both after and before the curing step.

Preferably, radiation-curing layer and the print layer are made of urethane, and a reinforcing layer is provided between the compressible layer and the print layer. The reinforcing layer is also preferably made of urethane.

Preferably, the radiation-curing layer is made of urethane foam formed by blowing carbon dioxide, air or another blowing agent into the urethane. Compressible microspheres however could also be embedded in the urethane to provide the compressibility.

The reinforcing layer preferably is made of a high durometer urethane of greater than 70 shore A, most preferably about 70 shore D. The reinforcing layer preferably is thinner than the compressible layer.

The print layer preferably is made of a urethane with a durometer of less than 90 shore A and most preferably of about 60 shore A.

The present invention also provides a printing blanket comprising:

a compressible layer made of a radiation-curing polymer; and a print layer.

The blanket preferably includes a sleeve, for example made of metal. The sleeve can be made continuously by wrapping a metal tape around a rotating sleeve-forming station.

The print layer preferably is made from a radiation-curing polymer.

The radiation curing polymer preferably is UV-curing urethane.

BRIEF DESCRIPTION OF THE DRAWINGS

The present invention is described in more detail with reference to the following figures, in which.

DETAILED DESCRIPTION

Figure 1:
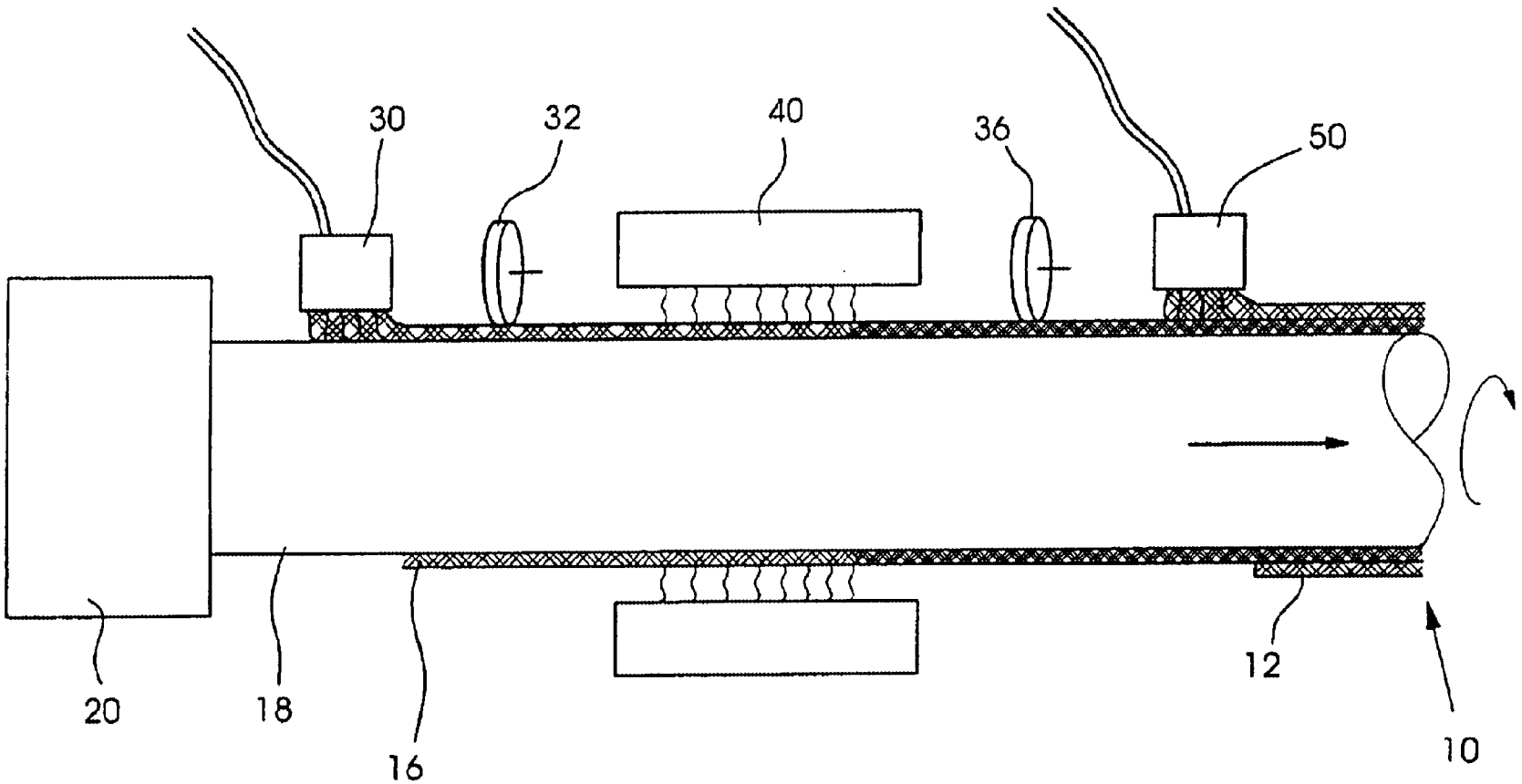
FIG. 1 shows a device for manufacturing a tubular printing blanket according to the present invention.

FIG. 1 shows a device for manufacturing a preferred lithographic continuous process gapless tubular printing blanket 10. In this regard, the term "continuous process" indicates that the process creates a continuous tubular blanket of undetermined axial length.

A sleeve forming station 20 forms or has a base sleeve 18. Base sleeve 18 may be fixed or friction fitted to station 20, in which case the sleeve is of stable shape and remains on the station. The layers to be deposited on the sleeve slide off or are drawn off to form the blanket. Alternately, the base sleeve 18 is part of the actual printing blanket 10, in which case the sleeve 18 is continuously formed and cut off at the end of the sleeve forming station 20 when a desired length is reached, as described in the incorporated-by-reference U.S. patent application Ser. No. 09/716,696, for example. Sleeve 18 preferably rotates and translates and is continuously formed.

Over sleeve 18 is applied a compressible layer 16 of ultraviolet-curing urethane, commercially available from the Bomar Specialties Company of Connecticut, for example. The urethane may be applied for example in liquid form from a polymer liquid applicator 30, which for example may be a spraying device. The radiation-curing urethane may be premixed before application, and then blown with a blowing agent or carbon dioxide for example to add compressibility.

A smoothing station 32, for example a doctor blade or a planing device, can reduce undulations in the applied compressible layer 16.

The layer 16 is then cured using a radiation source 40, for example a UV light source. An electron beam or other radiation could be used depending on the type of curing initiators in the polymer to be cured. Layer 16 then cures to form the compressible layer of blanket 10.

A second smoothing station 36 then may contact the urethane layer 16 to smooth layer 16 to reduce imperfections such as undulations. Smoothing station 36 may be, for example, a grinding device.

Figure 2:
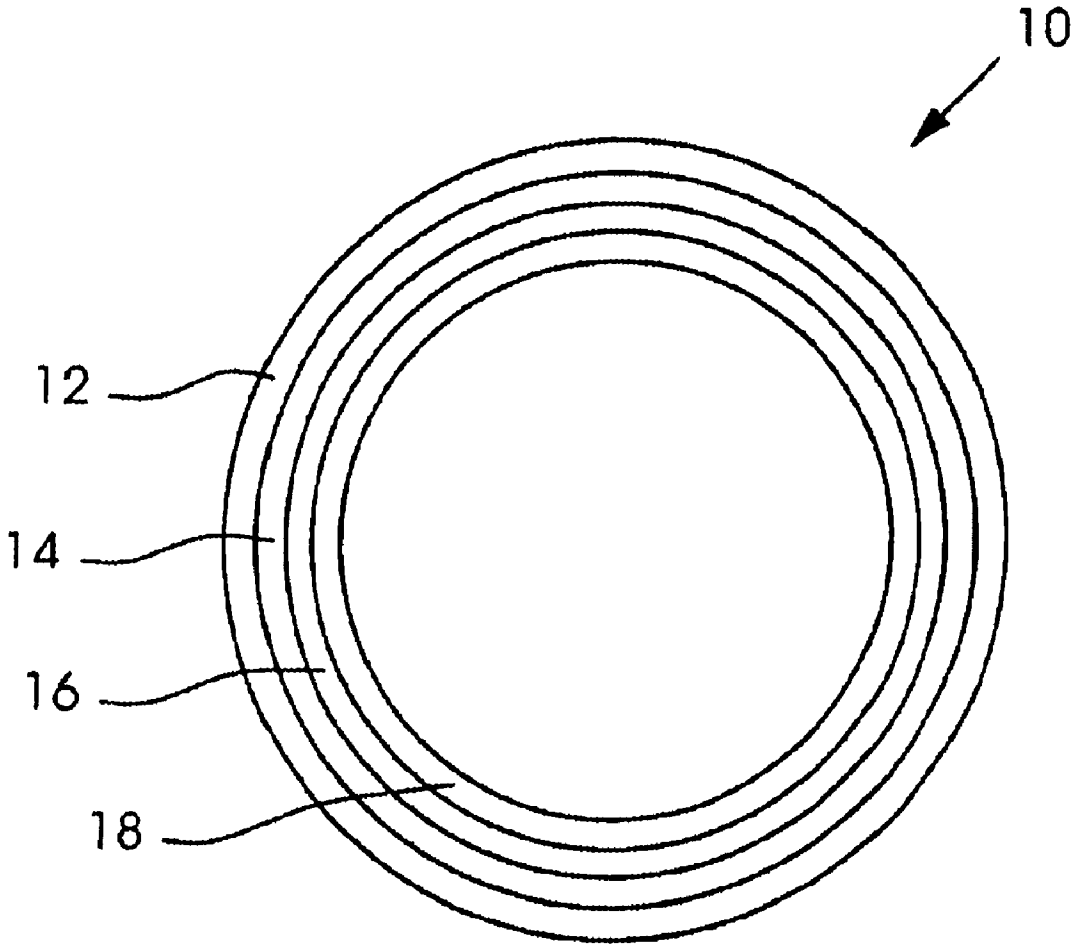
FIG. 2 shows a cross-sectional view of a blanket according to the present invention.

Over the compressible layer 16 after grinding may be deposited, for example by a liquid applicator device, a reinforcing layer 14 (FIG. 2). The durometer of the reinforcing layer, which also may be urethane, preferably is greater than 70 shore A, and preferably about 70 shore D.

A second liquid applicator 50 similar to device 30 then forms a print layer 12 over the compressible layer 16. The urethane of the print layer may have a shore A durometer value of about 60, for example. The deposited print layer forms a seamless and gapless layer when it sets. If desired, a scraper, planing device and/or a grinding device may be used to correct or reduce any imperfections such as undulations in the print layer. Both the print layer 12 and the reinforcing layer 14 (FIG. 2) may be made from radiation-curing polymers, and a radiation source may be provided after the respective applicators.

Once the print layer 12 is complete, the blanket continues moving in the direction of arrow 5 until a desired length is reached, at which time the blanket is cut, for example by a rotating cutter or saw.

FIG. 2 shows a cross-sectional view of the blanket 10, with sleeve 18, compressible layer 16, reinforcing layer 14 and print layer 12.

The compressible radiation-curing polymer may be made compressible in any manner known in the art, including for example, through the use of microspheres, blowing agents, foaming agents, or leaching. Examples of such methods are disclosed for example in U.S. Pat. Nos. 5,768,990, 5,553,541, 5,440,981, 5,429,048, 5,323,702, and 5,304,267.

As used herein, the term print layer, or printing layer refers to a polymeric material such as urethane which is suitable for transferring an image from a lithographic printing plate or other image carrier to web or sheet of material, with such print quality as the particular printing application requires.

Although the preferred embodiments of the printing blanket in accordance with the present invention have been illustrated herein as including a compressible layer, a reinforcing layer, and a print layer, it should be understood that the sleeve is not necessarily part of the blanket.

It should be understood that a blanket in accordance with the present invention might also include multiple compressible layers, multiple build up layers, or multiple reinforcing layers.

With regard to the reinforcing layer, although the reinforcing layer is preferably formed from urethane, the reinforcing layer also may be formed by winding fabric or plastic tape, cords or threads around the work piece.

What is claimed is:

1. A device for manufacturing a printing blanket comprising:

a sleeve forming station, the sleeve forming station forming a continuously axially-moving base sleeve;

a sleeve translation device, the sleeve translation device translating the base sleeve in a continuously-axially moving fashion in a translation direction;

a liquid applicator located downstream of the sleeve forming station in the translation direction, the liquid applicator applying a radiation-curable polymer to the continuously axially-moving base sleeve;

a radiation source located downstream of the liquid applicator in the translation direction, the radiation source curing the radiation-curable polymer on the continuously axially-moving base sleeve; and a cutter located downstream of the radiation source in the translation direction, the cutter cutting the continuously axially-moving base sleeve into a desired length.

2. The device as recited in claim 1 wherein the blanket is continuously formed.

3. The device as recited in claim 1 further comprising a second liquid applicator applying a second polymer over the radiation-curable polymer.

4. The device as recited in claim 1 wherein the radiation-curable polymer is a compressible liquid polymer.

5. The device as recited in claim 1 wherein the radiation-curable polymer is radiation-curable polyurethane.

6. The device as recited in claim 5 wherein the radiation source is ultraviolet light.

7. The device as recited in claim 1 wherein the radiation source is one of ultraviolet light and an electron beam.

8. The device as recited in claim 1 wherein the base sleeve is rotatable.

9. A method for forming a tubular printing blanket comprising the steps of:

forming a continuously axially-moving base sleeve in a sleeve forming station;

translating the base sleeve in a continuously axially-moving fashion in a translation direction;

placing a radiation-curable polymer over the base sleeve downstream from the sleeve-forming station using a liquid applicator so as to form a layer of a printing blanket;

curing the radiation-curable polymer on the base sleeve using a radiation source downstream of the liquid applicator; and cutting the base sleeve into a desired length downstream of the radiation source.

10. The method as recited in claim 9 further comprising rotating the base.

11. The method as recited in claim 9 wherein the layer is a compressible layer.

12. The method as recited in claim 11 further comprising providing a print layer over the compressible layer.

13. The method as recited in claim 9 wherein the radiation curing polymer is radiation-curing urethane.

14. The method as recited in claim 9 wherein the radiation source is a UV light source.

* * * * *